United States Patent [19]

Wirth

[11] Patent Number: 5,071,044

[45] Date of Patent: Dec. 10, 1991

[54] APPARATUS FOR FOLDING A CUT TIE IN A TIE SEWING MACHINE

[75] Inventor: Rudi Wirth, Schwarzenbach/Wald, Fed. Rep. of Germany

[73] Assignee: Liba Maschinenfabrik GmbH, Naila, Fed. Rep. of Germany

[21] Appl. No.: 573,238

[22] Filed: Aug. 27, 1990

[30] Foreign Application Priority Data

Sep. 1, 1989 [DE] Fed. Rep. of Germany ..... 3929110

[51] Int. Cl.[5] ..... A41H 33/00; D06C 15/00; D05B 23/00

[52] U.S. Cl. ..... 223/38; 223/37; 223/81; 223/82; 112/121.22

[58] Field of Search ..... 223/37, 38, 82, 83, 223/81; 112/147, 141, 120, 121.22

[56] References Cited

U.S. PATENT DOCUMENTS

| | | | |
|---|---|---|---|
| 254,576 | 3/1882 | Steinboack | 223/37 X |
| 2,188,301 | 1/1940 | Naftali et al. | 223/37 X |
| 2,228,063 | 1/1941 | Rubler | 223/37 |
| 2,275,457 | 3/1942 | Newman | 112/121.22 |
| 2,277,366 | 3/1942 | Naftali | 112/121.22 |
| 2,283,691 | 5/1942 | Naftali | 112/121.22 |
| 2,286,224 | 6/1942 | Naftali | 223/38 X |
| 2,350,104 | 5/1944 | Fiumedoro | 712/121.22 |
| 2,397,081 | 3/1946 | Baker et al. | 112/121.22 |
| 2,665,935 | 1/1954 | Gilbert et al. | 223/38 X |
| 2,748,729 | 6/1956 | Davidowitz | 112/121.22 |
| 3,144,182 | 8/1965 | Freeman | 223/37 |
| 3,588,089 | 6/1971 | Flanagan | 112/147 X |
| 4,144,439 | 1/1980 | Schulz | 112/147 X |
| 4,222,507 | 9/1980 | Bengtsson et al. | 223/37 |
| 4,574,717 | 3/1986 | Jüneman | 112/121.22 |

FOREIGN PATENT DOCUMENTS

| | | | |
|---|---|---|---|
| 2216550 | 11/1989 | United Kingdom | 112/121.22 |

*Primary Examiner*—Werner H. Schroeder
*Assistant Examiner*—Bibhu Mohanty
*Attorney, Agent, or Firm*—Bell, Seltzer, Park & Gibson

[57] ABSTRACT

A device for folding a cut-out 3 e.g. for a necktie in a sewing machine having a supporting table 2 which has a slit 29 into which a cut-out 3 laid over the slit is pressed in use, includes a folding sword which is composed of folding bars 17 set in a row and which is arranged above the slit 29 in such a manner that when the folding sword enters the slit, the tie cut-out is folded around the folding sword, while as a result of the folding bars 17 descending into the slit to different depths, the edges of the tie cut-out to be sewn project from the slit 29 to a substantially constant height. The folding bars are each provided with displaceable stops 22 which can be locked on the folding bars and which, during the descent of the folding sword, run against an abutment 18 extending transversely over all the folding bars to define the particular depth to which each folding bar 17 descends.

4 Claims, 3 Drawing Sheets

APPARATUS FOR FOLDING A CUT TIE IN A TIE SEWING MACHINE

CROSS-REFERENCE TO RELATED APPLICATIONS

This application is related to copending patent application Ser. Nos. 573,273 and 573,834, both filed on Aug. 27, 1990.

FIELD OF THE INVENTION

The invention relates to a device for folding cut-outs, e.g. for neckties, in a sewing machine. For convenience, the following description is made with reference to necktie sewing machines, but the invention is not limited thereto.

BACKGROUND OF THE INVENTION

In the tie sewing machines hitherto in use, because of the varying width of the tie cut-out over the length of the tie cut-out (in accordance with the divergent edges of the finished tie), the latter is pressed into a folding slit to different depths during the folding operation in order to obtain a substantially constant height of the edges of the tie cut-out projecting from the slit at the end of this operation. This different depth of pressing in is brought about in that the slit is given a corresponding depth profile along its length. Individual folding bars of a folding sword, which descend into the slit under the action of the force of gravity as a result of their weight, then press the tie cut-out down to the bottom of the slit in each case, where the individual folding bars are stopped. When the tie sewing machine in question has to be converted from one shape of tie to another, a correspondingly profiled bottom has to be inserted in the slit each time. This means that, according to the number of tie shapes to be produced, a corresponding number of bottom profiles for the slit must be available.

SUMMARY OF THE INVENTION

It is the object of the invention to simplify the adaptation of such a sewing machine to another shape of cut-out. Accordingly, the invention provides a device for folding a cut-out in a sewing machine having a supporting table which has a slit into which the cut-out laid over the slit is pressed in use, and having a folding sword which is composed of folding bars set in a row and arranged above the slit in such a manner that, on the introduction of the folding sword into the slit, the cut-out is folded about the folding sword, while as a result of the folding bars descending to different depths into the slit, the edges of the cut-out to be sewn project out of the slit to a substantially constant height, wherein the folding bars are each provided with adjustable stops which, during the descent of the folding sword run up against abutment means to define the particular depth of the descent of each folding strip.

The adjustable stops make the insertion of a differently profiled bottom in the slit each time superfluous. Any desired shape of cut-out can be taken into account by the stops. The conversion of the sewing machine is effected in a simple manner since the stops merely have to be adjusted appropriately on the folding bars in question. This represents a relatively simple task since the folding bars are directly accessible above the supporting table.

BRIEF DESCRIPTION OF THE DRAWINGS

One embodiment of the invention is illustrated by way of example in the drawings, to which the following description refers, and in which.

DETAILED DESCRIPTION OF THE PREFERRED EMBODIMENTS

Figure 1:
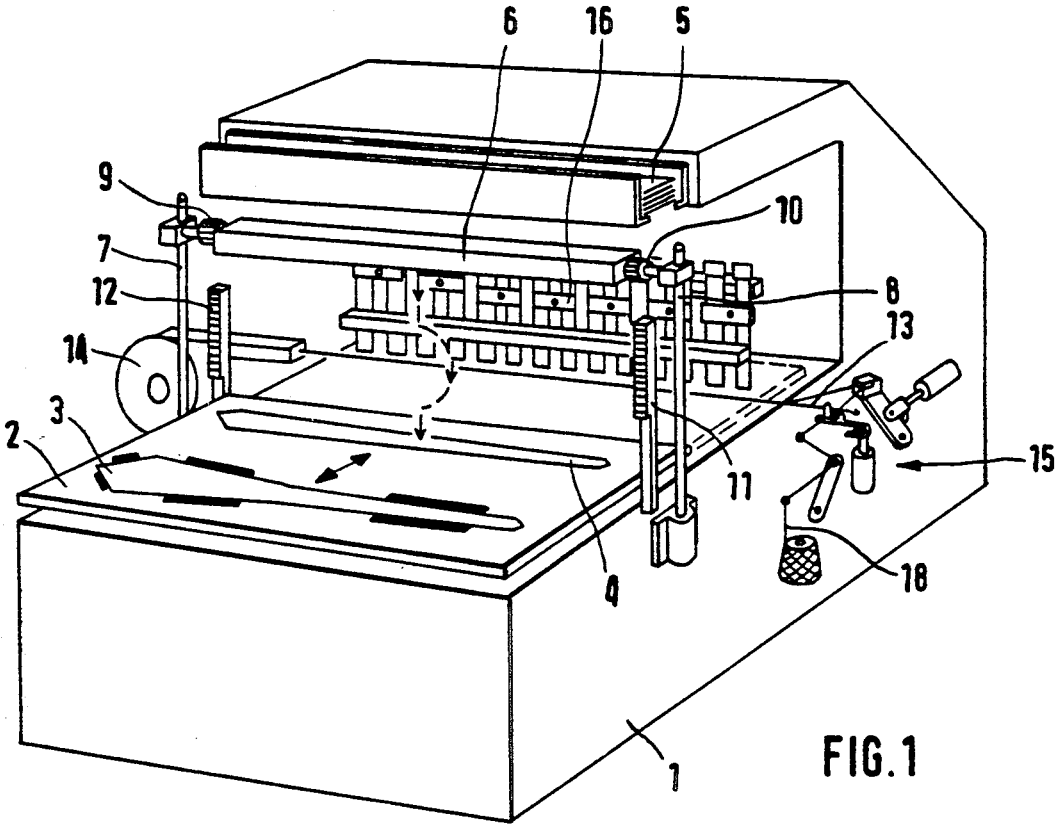
FIG. 1 shows a perspective view of a tie sewing machine as a whole.

The tie sewing machine illustrated in FIG. 1 consists of a machine frame 1 on which the supporting table 2 is mounted for displacement as indicated by the double headed arrow.

A tie cut-out 3 and tie stiffening 4 are laid on the supporting table 2. The tie cut-out 3 and the tie stiffening 4 are brought together by a displacement movement which is not material to the invention and are brought into the sewing position. Before the sewing operation, the tie cut-out 3 is folded by means of the folding sword 16 which is movable vertically up and down, and which will be described in more detail in connection with FIGS. 2 to 5.

The tie stiffening 4 is taken from a stack 5 by a gripping mechanism 6 which grasps the currently lowest layer of the stack 5 and deposits it on the supporting table 2, for which purpose the gripping mechanism 6 executes a rotational movement through 180° indicated in FIG. 1 by the broken line provided with arrowheads. This rotational movement comes about as a result of the fact that the gripping mechanism 6 is mounted for displacement on slide bars 7 and 8 and carries two pinions 9 and 10 which encounter two racks 11 and 12 during the downward movement of the gripping mechanism 6, as a result of which the gripping mechanism 6 executes the rotational movement through 180° during its further downward movement. The reverse sequence of movements occurs during the subsequent upward movement.

Apparatus suitable for feeding the stiffening to the supporting table 2 is described and claimed in our copending patent application Ser. No. 573,834, filed Aug. 27, 1990, and entitled, Apparatus for Feeding a Tie Insert to the Feed Table of a Tie Sewing Machine.

A sewing needle 13 consists of high-strength spring steel wire which is wound on a needle drum 14 in the retracted position of the needle 13. In order to thread a sewing thread 18, the needle 13 is pushed out of the needle drum 14 and finally arrives with its point in the region of a threading device 15 out of which it is pulled back again to carry out the sewing operation, the wire of the needle 13 being wound on the needle drum 14. In the course of this, the needle 13 runs up a longitudinal seam, the position of which corresponds to the needle 13 shown in FIG. 1.

A method of and apparatus for threading the needle is described and claimed in our copending patent application Ser. No. 573,273, filed Aug. 27, 1990, and entitled, Apparatus for Threading a Sewing Thread into the Needle of a Tie Sewing Machine.

The sewing operation is effected in known manner in that, during the advance of the needle 13 from the needle drum 14 to the threading device 15, the needle 13 pierces through the material of tie cut-out 2 and tie stiffening 4, which is held in an undulating shape, so that during the pulling back of the needle 13 with the sewing thread 18 threaded, the latter is pulled through the material in accordance with its undulating shape to sew the parts in question together. This is also a known operation.

Figure 2:
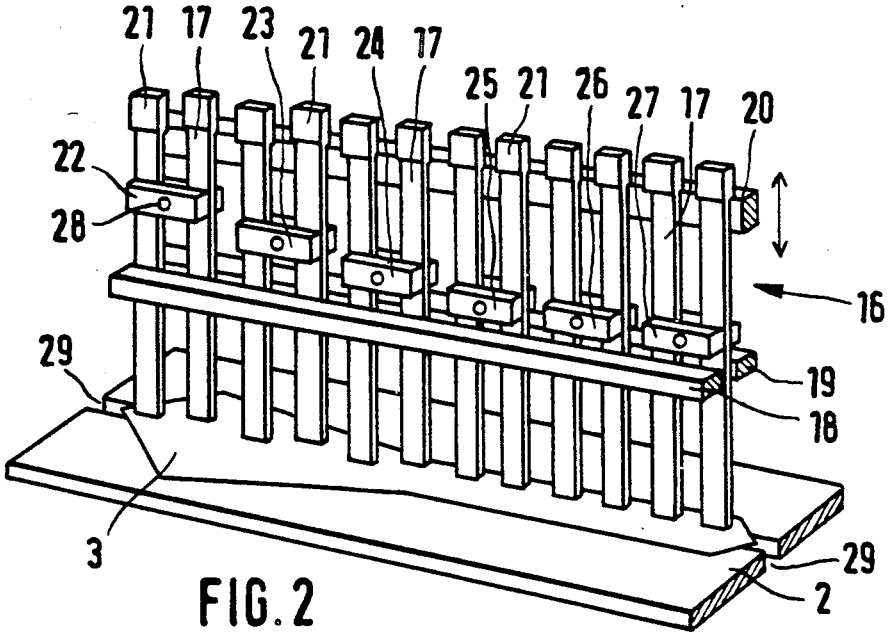
FIG. 2 shows the supporting table of such a machine with a tie cut-out laid on a folding slit and a folding sword arranged above it.

FIG. 2 shows a detail from FIG. 1, illustrating the folding sword 16 and the supporting table 2 situated beneath it. The folding sword 16 consists of folding bars 17 which are set in a row and which are held for longitudinal movement between the two guide rails 18 and 19. The folding bars 17 can therefore be pushed up and down between the guide rails 18 and 19. In the position of rest illustrated in FIG. 2, all the folding bars 17 are hanging on the lifting rail 20 which engages behind head members 21 so that on an upward and downward movement of the lifting rail 20 executed in accordance with the double arrow as shown, the individual folding bars 21 are correspondingly moved up and down.

Two folding bars 17 at a time are bridged by a stop 22 to 27 which is clamped to the folding bars 17 in question by means of screws 28. As a result of this clamping, the individual stops 22 to 27 can be brought selectively into different heights. As can be seen, the stops 22, 23 and 24 are arranged higher than the stops 25, 26 and 27 which are at the same height. It is, however, naturally also possible to provide each individual folding bar 17 with a stop.

The folding sword 16 composed of the individual folding bars 17 is arranged centrally above the slit 29 in the supporting table 2 so that when the folding sword 16 is lowered, it enters the slit 29. The tie cut-out 3, whose width varies along its length, is laid on the supporting table 2 covering the slit 29.

Figure 3:
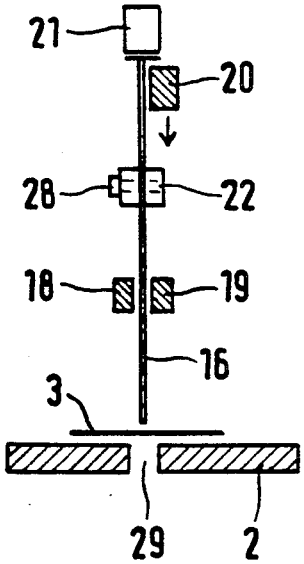
FIG. 3 shows the embodiment of FIG. 1, illustrated diagrammatically in side view.

In FIG. 3, the arrangement according to FIG. 2 is represented diagrammatically in side view. According to this, the folding sword 16 is held by the lifting rail 20 at a height above the tie cut-out 3.

Figure 4:
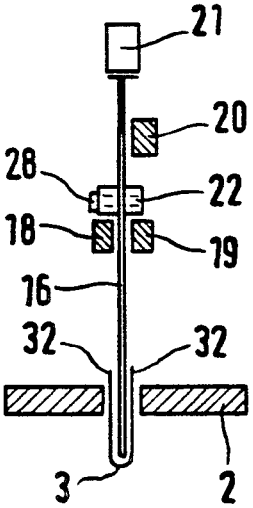
FIG. 4 shows the embodiment of FIG. 3 with the folding sword lowered.

The actuation of the folding sword 16 will now be explained with reference to FIG. 4, which shows the arrangement according to FIG. 3 with the folding sword 16 lowered. As a result of the lowering of the lifting rail 20 into the position illustrated in FIG. 4, the folding bars 17 are released so that they enter the slit 29 as a result of their weight while the end faces of the folding bars 17 facing the tie cut-out push the cut-out folded into the slit 29. In order to give the individual folding bars 17 the necessary weight, the head members 21 are made of lead. The folding bars 17 each travel into the slit 29 until the stops 22 to 27 encounter the guide rails 18 and 19 which thus form an abutment for the downward movement of the folding bars 17. The folding bars 17 descend into the slit 29 according to the adjustment in height of the stops 22 to 27 and at the same time take a corresponding length of the material of the tie cut-out 3 with them. In order to restore the folding sword 16 to its position of rest above the supporting table 2, the lifting rail 20 is raised, to strike against the heads 21 of the folding bars 17 and thus pull the folding bars 17 out of the slit 29.

Figure 5:
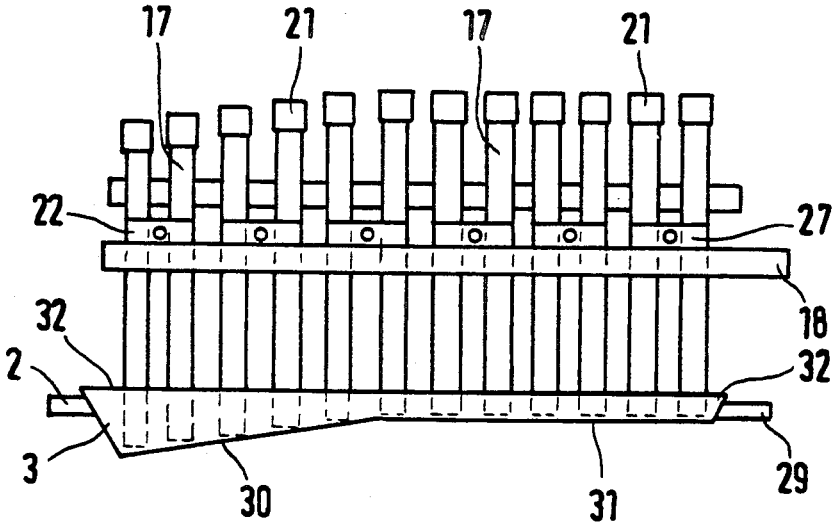
FIG. 5 shows the position of the folding bars of the lowered folding sword.

The profile resulting over the length of the tie cut-out 3 when the tie cut-out 3 is pressed into the slit 29 is illustrated in FIG. 5. As can be seen, the folding bars 17 project to different depths into the slit 29 in the supporting table 2 according to the place where the stops 22 to 27 (see FIG. 2) are clamped onto the folding bars 21. The joint clamping of a stop, for example the stop 22, onto two folding bars 17 renders it possible to clamp any two folding bars 17 gripped by one stop, for example 22, to be clamped at different heights.

The deeper pressing in of the tie cut-out 3 in the region 30 in comparison with the region 31, makes allowance for the different width along the finished tie (tie shape), since the profile along the regions 30 and 31 corresponds to the particular width measured over the finished tie.

If a tie cut-out 3 for a differently shaped tie is now laid on the supporting table 2 and then has to be pressed appropriately into the slit 29, the stops 22 to 27 must be clamped on correspondingly differently according to the shape of the tie in question, so that the tie sewing machine in question is converted quickly and easily to the other shape of tie. The readjustment of the stops 22 to 27 is facilitated by the fact that a template representing the particular width of the finished tie with a straight edge at one side is provided and this is then placed on one of the guide rails 18 and 19. The stops 22 to 27 and the folding bars clamped thereby can then easily be aligned along the edge of the template following the profile.

I claim:

1. An apparatus for folding a necktie cut-out blank on a sewing machine comprising a support table adapted to support thereon a necktie cut-out in a flat, unfolded position;

a longitudinal slit positioned in the support table and dimensioned for receiving thereon a necktie cut-out;

folding sword means positioned above the slit and being movable within the slit to press the necktie cut-out into the slit and fold the necktie cut-out about the sword, said folding sword means comprising a plurality of bar members positioned in a row above said slit, each bar member being vertically movable into the slit;

a stop positioned on each bar member; and abutment means positioned adjacent the bar members for engaging the stops as the bar members move downward into the slit for limiting the depth of penetration of each bar member into the slit to define the depth in which the necktie cut-out is inserted into the slit.

2. An apparatus according to claim 1 wherein said stops positioned on said bar members are movable along the bar members for adjusting the depth of penetration of the bar members into the slit and adjusting the depth in which the necktie cut-out is inserted into the slit.

3. An apparatus according to claim 1 wherein said bar members are oriented in a vertical direction and the top portion of the bar members are weighted for forcing the bar members into the slit under the influence of gravity.

4. An apparatus according to claim 1 including a lifting rail extending substantially perpendicular to the bar members and being movable in a vertical direction, and wherein each bar member includes means positioned thereon for engaging said lifting rail to raise therewith as said lifting rail is raised.

* * * * *